US007438123B2

(12) United States Patent
Tadokoro

(10) Patent No.: US 7,438,123 B2
(45) Date of Patent: Oct. 21, 2008

(54) PIPE-TYPE HEAT EXCHANGE DEVICE AND MANUFACTURING METHOD THEREOF

(75) Inventor: Takeshi Tadokoro, Koga (JP)

(73) Assignee: Sanoh Industrial Co., Ltd., Ibaraki-ken (JP)

( * ) Notice: Subject to any disclaimer, the term of this patent is extended or adjusted under 35 U.S.C. 154(b) by 367 days.

(21) Appl. No.: 11/173,844

(22) Filed: Jul. 5, 2005

(65) Prior Publication Data

US 2006/0017284 A1 Jan. 26, 2006

(30) Foreign Application Priority Data

Jul. 26, 2004 (JP) ..... 2004-216684

(51) Int. Cl.
*F28D 7/16* (2006.01)

(52) U.S. Cl. ..... 165/164; 29/890.03; 228/183

(58) Field of Classification Search ..... 165/164; 228/183, 258
See application file for complete search history.

(56) References Cited

U.S. PATENT DOCUMENTS

| | | | | | |
|---|---|---|---|---|---|
| 1,890,784 | A | * | 12/1932 | Jacobus | 122/478 |
| 1,989,772 | A | * | 2/1935 | Robinson | 165/171 |
| 2,521,040 | A | * | 9/1950 | Casetta | 62/509 |
| 2,539,886 | A | * | 1/1951 | Bisch | 165/164 |
| 2,756,032 | A | * | 7/1956 | Dowell | 165/121 |
| 3,446,032 | A | * | 5/1969 | Bottum | 62/513 |
| 3,997,002 | A | * | 12/1976 | Baker et al. | 165/154 |
| 4,602,674 | A | * | 7/1986 | Eriksson | 165/70 |
| 6,129,147 | A | * | 10/2000 | Dumetz et al. | 165/177 |

* cited by examiner

*Primary Examiner*—Allen J Flanigan
(74) *Attorney, Agent, or Firm*—Posz Law Group, PLC

(57) ABSTRACT

The provision of a pipe-type heat exchange device wherein solder can be reliably filled between pipes attached together, resulting in a high heat transfer efficiency, comprising two pipes attached to each other through which fluids with differing temperatures are passed respectively, wherein a bar is attached to the pipes and wherein the pipes and the bar are subjected to brazing.

12 Claims, 3 Drawing Sheets

PIPE-TYPE HEAT EXCHANGE DEVICE AND MANUFACTURING METHOD THEREOF

BACKGROUND OF THE INVENTION

1. Field of the Invention

The present invention relates to a pipe-type heat exchange device with enhanced heat exchange properties as well as to the method of manufacturing thereof.

2. Description of the Related Art

As an example of a pipe-type heat exchange device wherein two pipes are attached to each other and wherein heat exchange of the fluids flowing through the above pipes is carried out, a heat exchange device is cited wherein a cooling water pipe leading to the connector pipe connecting the engine head bypass outlet to the water pump is positioned along an engine blow-by gas pipe and wherein the heat of the cooling water pipe is supplied to the blow-by gas pipe (refer to, for example, Japan Examined Utility Model Application Publication S64-7208).

In the pipe-type heat exchange device as described in Japan Examined Utility Model Application Publication S64-7208, both pipes are subjected to brazing and closely linked to each other in order to efficiently transfer the heat of the cooling water to the blow-by gas pipe.

Other examples of pipe-type heat exchange devices are those composed of a blow-by gas pipe and an exhaust gas reflux pipe (refer to, for example, Japan Examined Utility Model Application Publication S62-33049) or those composed of a capillary tube and a refrigerant suction side pipe of a compressor in a refrigeration circuit (refer to, for example, Japanese Patent Application Laid-open No. 2001-248979).

In some cases, since the pipes are wave-shaped and have a straightness of approximately ±0.1 mm, gaps result between the pipes even when they have been attached together. In particular, when the concave sections of the generating line in both pipes face each other and when the gaps exceed the specified gap, the solder does not persist over the above section, resulting in an inferior solder. This results in reduced heat exchange efficiency.

The pipes are temporarily held together using a stay before being placed in a furnace for brazing to be carried out. However, there are cases in which the pipes separate from each other during the above process, resulting in insufficient brazing between the pipes. This results in defective products.

SUMMARY OF THE INVENTION

With the foregoing in view, it is an object of the present invention to provide a pipe-type heat exchange device and its method of manufacture wherein solder can be reliably filled between the adjacently-placed pipes, enabling heat to be transferred with greater efficiency.

In order to solve the above problems, the pipe-type heat exchange device of the present invention comprises two pipes attached to each other through which fluids with differing temperatures are passed respectively, wherein a bar is attached to the pipes and wherein the pipes and the bar are subjected to brazing.

In the above pipe-type heat exchange device, one pipe is a blow-by gas pipe, whereas the other is a cooling water pipe leading to the connector pipe connecting the engine head bypass outlet to the water pump, or an exhaust gas reflux pipe connecting an exhaust system and an intake gas system.

The material used for the above bar may be the same as that used for the pipe. However, this is by no means limited to the above, provided the material can be subjected to brazing.

In the pipe-type heat exchange device of the present invention, even when the distance between the sections of both pipes exceeds the specified gap, the gap between the pipes and the bar attached between the pipes remains small. This results in strong brazing between the above bar and the pipes, where both pipes are satisfactorily linked thermally via the above bar. This enables the provision of a pipe-type heat exchange device with high heat transfer efficiency.

In the pipe-type heat exchange device of the present invention, two pipes through which fluids with differing temperatures are passed respectively are attached to each other sandwiching a continuous sheet material, wherein the above pipes and sheet material are subjected to brazing.

In the above pipe-type heat exchange device, as mentioned above, one pipe is a blow-by gas pipe, whereas the other is a cooling water pipe leading to the connector pipe connecting the engine head bypass outlet to the water pump, or an exhaust gas reflux pipe connecting an exhaust system and an intake gas system.

The material used for the above sheet material may be the same as that used for the pipe. However, this is by no means limited to the above, provided the material, as above, can be subjected to brazing.

In the pipe-type heat exchange device of the present invention, the gap between the surface of the sheet material and the pipe is smaller than that when the pipes are facing each other. This results in strong brazing between the above sheet material and pipe, where both pipes are satisfactorily linked thermally via the above sheet material. As above, this enables the provision of a pipe-type heat exchange device with high heat transfer efficiency.

In both pipe-type heat exchange devices of the present invention as mentioned above, the above bar and sheet material should preferably be a filled-in solid bar or sheet material.

A filled-in solid bar or sheet material located between the two pipes increases the area of heat transfer. This further enhances the heat transfer efficiency of the pipe-type heat exchange device.

In both pipe-type heat exchange devices of the present invention as mentioned above, the above pipes should preferably be adjacently fixed together by a stay.

In this case, the link between the two pipes is strengthened by the stay, where the bar or sheet material located between the above pipes altogether contributes to the thermal link between the pipes. The material of the bar or sheet material selected should preferably emphasize thermal conductivity over strength.

In the manufacture of both pipe-type heat exchange devices of the present invention as mentioned above, the above bar or sheet material should preferably be temporarily held together with the pipes, which is then placed in a furnace and subjected to brazing.

Since the bar or sheet material is temporarily held together with the pipes prior to carrying out brazing within the furnace, the gaps between the two are maintained, ensuring stronger brazing.

The bar or sheet material and the pipes are temporarily held together by tightening the stay or by partial welding the above or welding on the stay laid across the pipes.

DESCRIPTION OF THE PREFERRED EMBODIMENTS

Figure 1:
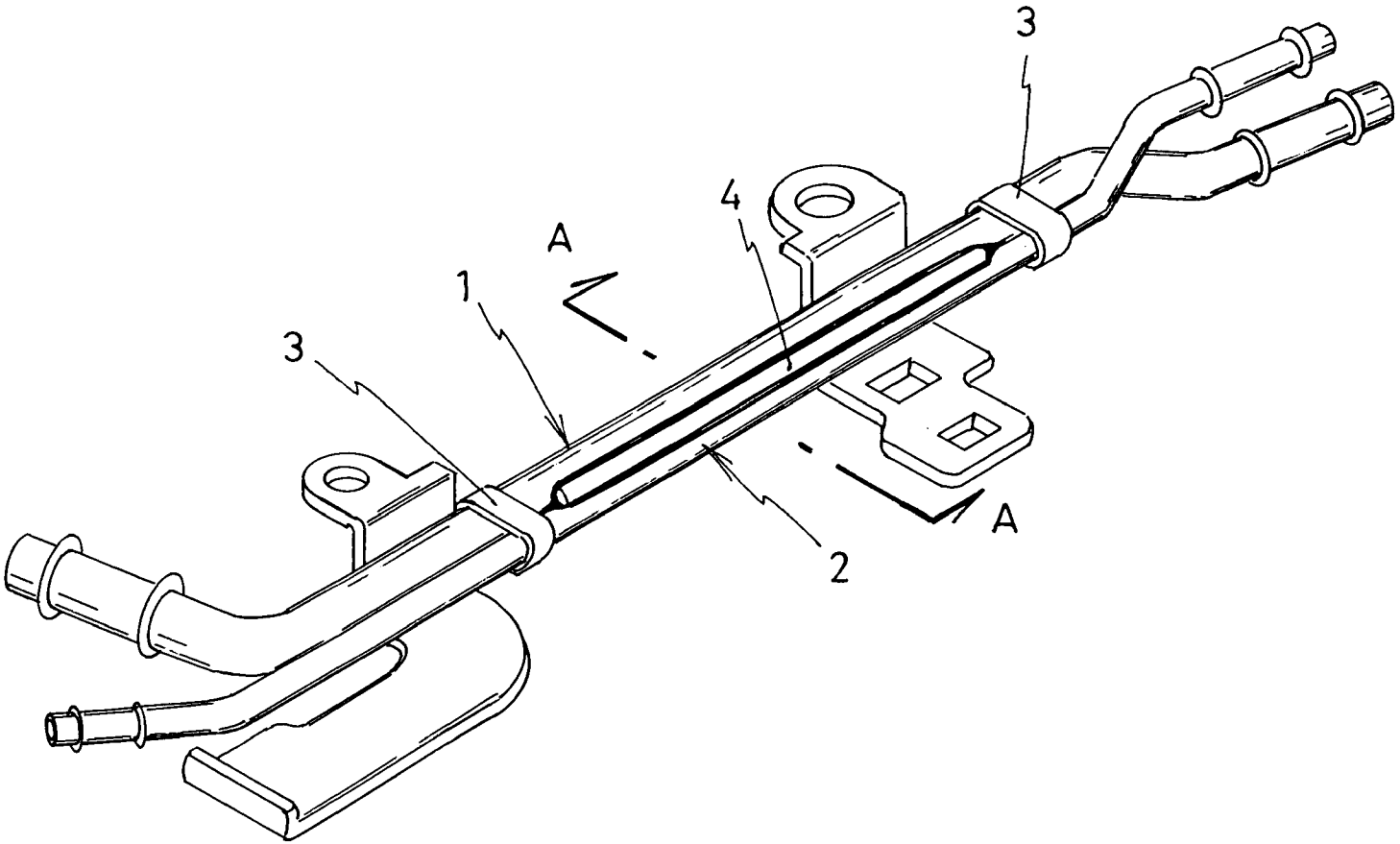
FIG. 1 is a conceptual slide view showing a pipe-type heat exchange device composed of a blow-by gas pipe and a cooling water pipe as a pipe-type heat exchange device related to the present invention.

The pipe-type heat exchange device and its method of manufacture as related to the present invention are described below with reference to the diagrams.

Blow-by gas pipe 1 of the pipe-type heat exchange device as shown is a pipe linking an engine crankcase and suitable locations along an intake gas passage; for example, the downstream section of a carburetor. Water cooling pipe 2 is a pipe linking an engine cooling passage outlet and a water pump.

In the above pipe-type heat exchange device, the blow-by gas pipe 1 and the cooling water pipe 2 are attached to each other, across which a stay 3 is laid. This stay 3 is temporarily held on by means of spot welding, projection welding or TGI welding. A filled-in solid bar 4 is attached between the above pipes 1 and 2. This bar 4 is temporarily held on by means of spot welding, projection welding or TGI welding. The pipe-type heat exchange device is then manufactured by subjecting it to brazing within a furnace.

Figure 2:
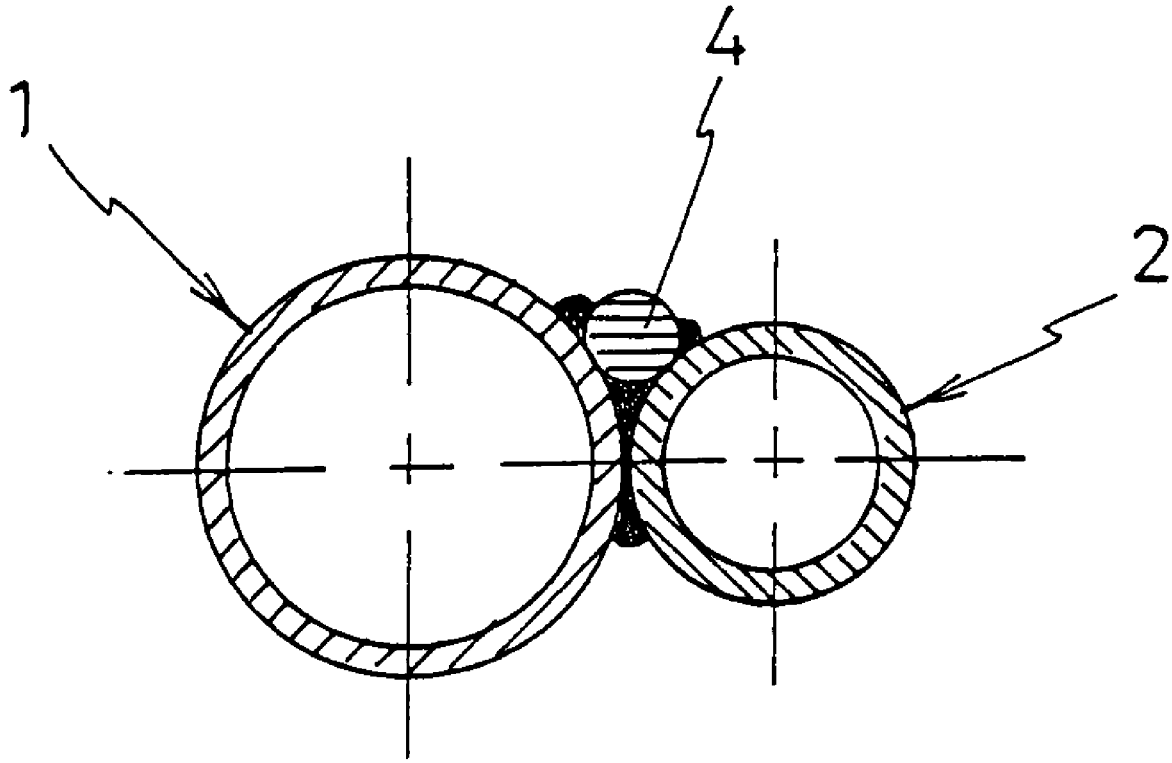
FIG. 2 is a cross section along the A-A line as shown in FIG. 1.

In the pipe-type heat exchange device manufactured as above, the two pipes 1 and 2 are strongly linked together by means of the stay 3. As shown in FIG. 2, the solder not only flows in between the pipes 1 and 2, but also flows in between the respective pipes 1 and 2 and the filled-in solid bar 4. This results in a satisfactory thermal link between pipe 1 and 2.

In the above pipe-type heat exchange device, the heat of the hot water flowing through cooling water pipe 2 which has been heated by the engine is transferred to the blow-by gas pipe 1 which is thermally linked to the above cooling water pipe 2. The blow-by gas flowing through the above blow-by gas pipe 1 is efficiently heated to prevent or thaw the freezing of moisture within the above gas.

In the present embodiment, bar 4 is attached to one side of where the pipe 1 and 2 join. Needless to say, bar 4 may also be attached to the other side. Also, bar 4 does not necessarily have to be a filled-in solid bar, and may be a hollow pipe-shaped bar. Naturally, however, the bar 4 should preferably be a filled-in solid bar in terms of heat transfer efficiency.

In the present embodiment, the stay 3 is laid across the pipes 1 and 2, and the stay 3 and the respective pipes 1 and 2 are welded together. As a result, pipes 1 and 2 are temporarily held together. The pipes 1 and 2 may also be temporarily held together by tightening the stay 3.

Figure 3:
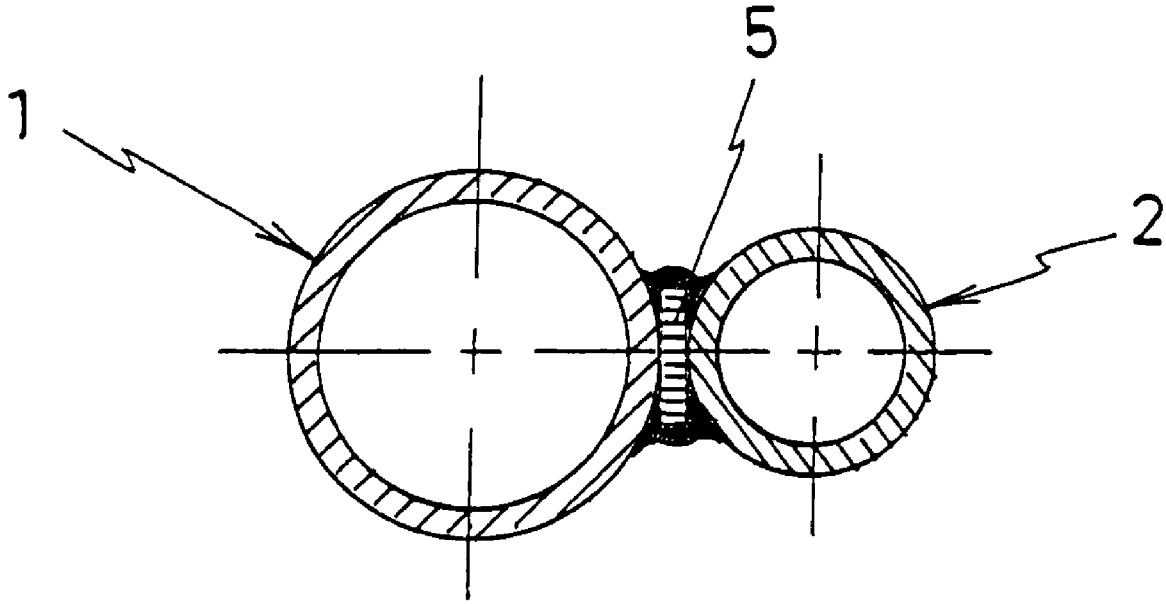
FIG. 3 is a cross section showing another embodiment of the pipe-type heat exchange device related to the present invention.

In the present embodiment, the bar 4 is attached between the pipes 1 and 2. However, as shown in FIG. 3, a continuous sheet material 5 may also be inserted between the pipes 1 and 2 and be subjected to brazing within a furnace.

In this case, the pipes 1 and 2 and the sheet material 5 are temporarily held together by means of spot welding, projection welding or TGI welding prior to brazing. In terms of heat transfer efficiency, the sheet material 5 should, as with the above bar 4, preferably be a filled-in solid sheet material 5. The pipes 1 and 2 and the sheet material 5 may also be temporarily held together by tightening the stay 3 attached to pipes 1 and 2.

The material used for bar 4 and sheet material 5 should preferably be made of a copper material or copper plating since this improves the distribution of the solder. This results in a further improved embodiment.

In the pipe-type heat exchange device of the present invention, in addition to a blow-by gas pipe and a cooling water pipe as shown in the above embodiment, pipe-type heat exchange devices may also be used which are composed of a blow-by gas pipe and an exhaust gas reflux pipe, or a capillary tube and a refrigerant suction side pipe of a compressor in a refrigeration circuit.

What is claimed is:

1. A pipe-type heat exchange device comprising:

two pipes attached to each other through which fluids with differing temperatures are passed respectively, the pipes having a cylindrical cross-section; and a bar having a cylindrical cross-section being attached to and arranged between the pipes, the bar having a cylindrical cross-section with a diameter less than that of the pipes, wherein the pipes and the bar are held together by brazing, and the two pipes are adjacent to one another and include a first pipe and a second pipe, and a longitudinal axis of the first pipe is outside of the second pipe and is spaced apart from an outer surface of the second pipe.

2. A pipe-type heat exchange device comprising:

two pipes through which fluids with differing temperatures are passed respectively are attached to each other, the pipes having a cylindrical cross-section; and a continuous sheet material being sandwiched between the pipes, a width of the continuous sheet material being smaller than diameters of the cross-section of the pipes, wherein the pipes and sheet material are held together by brazing, and the two pipes are adjacent to one another and include a first pipe and a second pipe, and a longitudinal axis of the first pipe is outside of the second pipe and is spaced apart from an outer surface of the second pipe.

3. The pipe-type heat exchange device of claim 1, wherein the bar is a filled-in solid bar.

4. The pipe-type heat exchange device of claim 2, wherein the sheet material is a filled-in solid sheet material.

5. The pipe-type heat exchange device of claim 1, wherein the pipes are adjacently fixed together by a stay.

6. The pipe-type heat exchange device of claim 2, wherein the pipes are adjacently fixed together by a stay.

7. A method of manufacturing the pipe-type heat exchange device of claim 1, wherein the bar and the pipes are temporarily held together, and the bar and the pipes are placed in a furnace and subjected to brazing while being temporarily held together.

8. A method of manufacturing the pipe-type heat exchange device of claim 2, wherein the sheet material and the pipes are temporarily held together, which is then placed in a furnace and subjected to brazing and the sheet material and the pipes are placed in a furnace and subjected to brazing while being temporarily held together.

9. The pipe-type heat exchange device of claim 1, further comprising a heat-conductive material filling any openings between the pipes and the bar.

10. The pipe-type heat exchange device of claim 2, further comprising a heat-conductive material filling any openings between the pipes and the sheet material.

11. The pipe-type heat exchange device of claim 1, wherein a longitudinal axis of the rod, the longitudinal axis of the first pipe and a longitudinal axis of the second pipe are parallel to one another.

12. The pipe-type heat exchange device of claim 2, wherein a longitudinal axis of the continuous sheet material, the longitudinal axis of the first pipe and a longitudinal axis of the second pipe are parallel to one another.

* * * * *